United States Patent [19]

Jackson

[11] 4,104,868

[45] Aug. 8, 1978

[54] PRECAST CHIMNEY SYSTEM

[75] Inventor: Kenneth Roy Jackson, Aylesford, Near Maidstone, England

[73] Assignee: Hankin-Baker Limited, Scarborough, Canada

[21] Appl. No.: 807,501

[22] Filed: Jun. 17, 1977

[51] Int. Cl.[2] ..... E04H 12/12

[52] U.S. Cl. ..... 52/743; 52/249

[58] Field of Search ..... 52/245, 249, 426, 427, 52/428, 429, 747, 424, 425, 219, 218, 267, 744, 745

[56] References Cited

U.S. PATENT DOCUMENTS

| | | | |
|---|---|---|---|
| 341,362 | 5/1886 | Vaughan | 52/249 |
| 992,835 | 5/1911 | Wiederholdt | 52/425 |
| 1,041,389 | 10/1912 | Wiederholt | 52/425 |
| 1,781,699 | 11/1930 | Parmley | 52/224 |
| 2,185,799 | 1/1940 | Kennedy | 52/224 |
| 3,162,709 | 12/1964 | Davidson | 52/224 |

FOREIGN PATENT DOCUMENTS

| | | | |
|---|---|---|---|
| 152,158 | 7/1953 | Australia | 52/245 |
| 682,354 | 6/1966 | Belgium | 52/426 |

*Primary Examiner*—John E. Murtagh

*Attorney, Agent, or Firm*—Shoemaker and Mattare, Ltd.

[57] ABSTRACT

There is provided a method of constructing a chimney, which includes the steps of providing an inner precast lining composed of interfitting segments stacked vertically, providing a precast concrete outer wall composed of interfitting segments in stacked relationship surrounding the lining but spaced outwardly therefrom to define an interstitial gap, providing longitudinal reinforcing steel bars within the interstitial gap, and pouring in situ concrete into the interstitial gap and allowing the concrete to harden.

3 Claims, 5 Drawing Figures

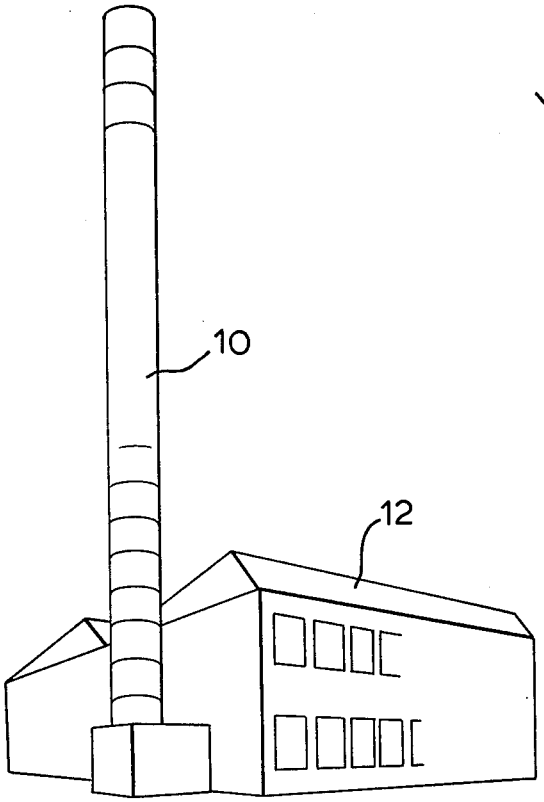
FIG. 1
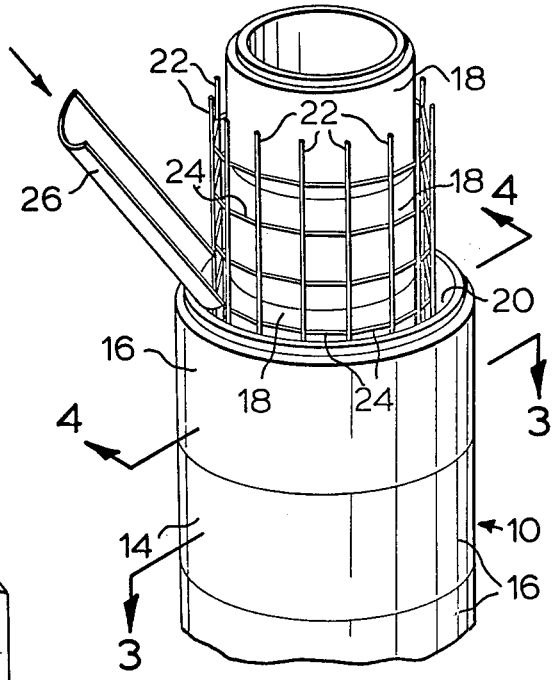
FIG. 2
FIG. 3
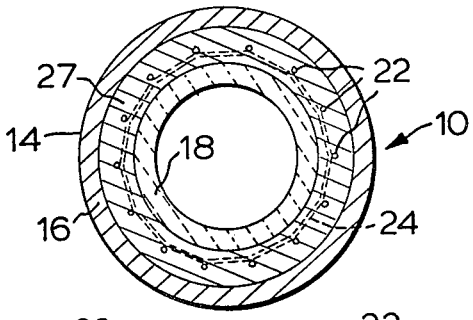
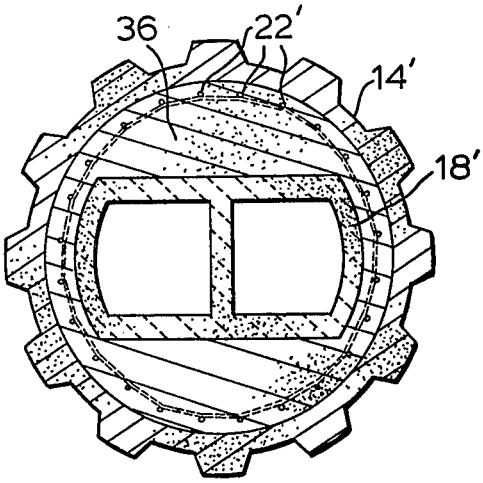
FIG. 5
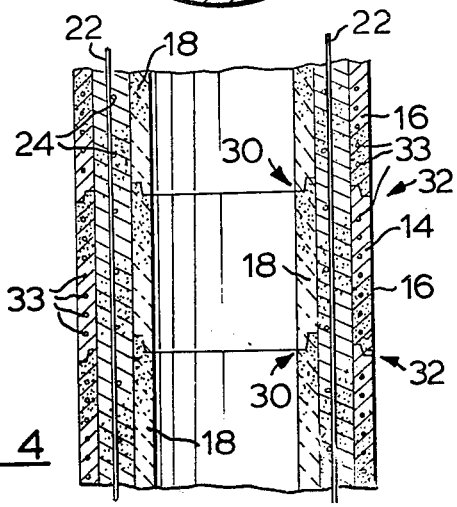
FIG. 4

PRECAST CHIMNEY SYSTEM

This invention relates generally to chimneys or stackes for flue gases, and has to do particularly with a method for constructing a chimney of this kind.

Many prior art chimney constructions include an inner, refractory lining of cylindrical or other suitable section, closely surrounded by an outer concrete wall. Typically, both the liner and the outer wall are composed of precast interfitting segments in stacked relationship, and the main strength of the chimney is invariably associated with the segments composing the outer wall. The individual precast segments of the outer wall, in the prior art, are typically provided with both circumferential reinforcing steel (to allow the wall to resist hoop stresses) and also means for receiving longitudinal reinforcing bars (rebars). The latter are typically provided in the form of open-ended pipes extending longitudinally of the outer wall segments, in such a way that when the segments are stacked one on top of the other these pipes can be aligned, and can thus receive elongated reinforcing bars which can extend from the top to the bottom of the chimney.

This necessity for providing both circumferential and longitudinal reinforcement within the outer wall segments results in considerable expense in the precasting of these segments, and involves tricky manoeuvers in ensuring that the adjacently stacked outer wall segments are properly aligned so that the longitudinal reinforcing bars can be inserted.

It is with the foregoing disadvantages of the prior art method in mind that the present invention has been developed.

Accordingly, this invention provides a method of constructing a chimney, comprising the steps: providing an inner precast lining composed of interfitting segments in stacked relationship, providing a precast concrete outer wall composed of interfitting segments in stacked relationship surrounding the lining and spaced outwardly therefrom to define an interstitial gap, providing longitudinal reinforcing steel bars within the interstitial gap, and pouring in situ concrete into the interstitial gap and allowing it to harden.

An example of the method of this invention is illustrated in the accompanying drawings, inwhich like numerals denote like parts throughout the several views, and in which:

FIG. 1 is a perspective view of a typical chimney installation;

FIG. 2 is a perspective view of a portion of the chimney of FIG. 1, in a partially completed condition;

FIG. 3 is a horizontal section through a completed portion of the chimney of FIG. 1;

FIG. 4 is a vertical section through a completed portion of the chimney of FIG. 1; and FIG. 5 is a horizontal section through a completed chimney of different sectional configuration from that illustrated in FIG. 3.

Essentially, the method of this invention involves the provision of an inner precast lining composed of interfitting segments, the latter to be situation within and spaced inwardly from the inner surface of a precast concrete outer wall also composed of interfitting segments. Within the interstitial gap existing between the lining and the outer wall the longitudinal reinforcing steel bars are supported and maintained while in situ concrete is poured into the interstitial gap and around the longitudinal reinforcing steel bars. When the in situ concrete hardens, there is in effect a three-part sandwich having the original precast concrete outer walls segments on the outside, the segments of the precast lining on the inside, and between them a hardened concrete layer in which the longitudinal reinforcing steel bars are embedded.

In FIG. 1, a chimney 10 is associated with a building 12 which may be a manufacturing plant, commercial building, or the like.

In FIG. 2, the chimney 10 is seen to consist of an outer wall 14 which includes precast concrete segments 16 in stacked relationship, within which a series of stacked, interfitting segments 18 of a precast refractory lining are disposed. As can be seen in FIG. 2, there is left an interstitial gap 20 between the outer wall 14 and the segments 18 of the lining.

Situated within and extending vertically longitudinally of the gap 20 are a plurality of longitudinal reinforcing steel bars 22, these being tied together with heavy wire 24 in known manner. A chute 26 for in situ concrete is provided to allow mixed concrete to be poured into the interstitial gap 20 around the longitudinal reinforcing bars 22. When the in situ concrete within the interstitial gap 20 hardens, the longitudinal reinforcing bars 22 will be embedded in the hardened concrete.

In FIG. 3, the hardened in situ concrete is shown by the numeral 27.

As can be seen in FIGS. 2 and 4, the segments 18 of the lining interfit at ogee joints 30 which are stepped down toward the inside of the chimney, while the segments 16 of the outer wall interfit at ogee joints 32 which are stepped down toward the outside of the chimney. This arrangement ensures that water running down the outside of the chimney will not penetrate into the structure of the wall, and also that water droplets running down inside the lining will likewise be prevented from entering the structure of the wall at the joints. Preferably, the interfitting adjacent segments both of the lining and of the outer wall are cemented together with mortar, with the mortar for the lining being of a refractory composition.

As can be seen in FIG. 4, the segments 16 of the precast outer wall contain internal reinforcing in the form of circumferential reinforcing steel hoops 33. The steel hoops 33 are provided to permit the outer wall to contain hoop stresses, and it will be appreciated that by providing the segments 16 only with the circumferential reinforcement and not with means to allow longitudinal reinforcement, there will be no need to align the outer wall segments 16 at the time of assembly.

FIG. 5 shows an alternative horizontal sectional construction of a chimney, which differs from that shown in FIG. 3 primarily in the outer fluting of the outer wall 14' and in the specific section of the refractory lining segments 18'. Again, however, the longitudinal reinforcing steel bars 22' are provided within the interstitial gap existing between the lining segments 18' and the outer wall 14', which is seen in FIG. 5 to be filled with hardened in situ concrete 36.

It will be appreciated that many other appropriate sectional configurations could be devised to utilize the advantage of the method of this invention.

While the lining segments are described as being of refractory material in this disclosure, it is to be understood that fibreglass material or other similar compositions could also be utilized.

I claim:

1. A method of constructing a composite chimney having a unitary cross-section through the wall thereof, comprising the steps of:

providing an inner precast lining composed of annular segments in interfitting stacked relationship, forming a plurality of reinforced annular segments by placing a plurality of circumferential steel hoops in each of a plurality of concrete annular segments to reinforce each of said segments against circumferential stressing, providing a precast concrete outer wall composed of said annular reinforced segments in interfitting relationship surrounding said lining and spaced outwardly therefrom in non-contacting relationship therewith to define an interstitial gap, providing linked longitudinal and circumferential reinforcing steel bars within said interstitial gap, and pouring in situ concrete into said interstitial gap and allowing it to harden to integrally connect said outer wall thereby forming a multilayer chimney which is composed of at least three layers and is solid and continuous through the thickness thereof about the circumference thereof with said reinforcing bars providing longitudinal and circumferential reinforcement to said concrete.

2. The method claimed in claim 1, in which the segments of the lining interfit at ogee joints which are stepped down toward the inside of the chimney, and in which the segments of the outer wall interfit at ogee joints which are stepped down toward the outside of the chimney.

3. The method claimed in claim 2, in which interfitting adjacent segments both of the lining and of the outer wall are cemented together with mortar, both the lining and the mortar for the lining being refractory.

* * * * *